US005771907A

United States Patent [19]

Dickson

[11] Patent Number: 5,771,907

[45] **Date of Patent: *Jun. 30, 1998**

[54] FLEXIBLE HAIR ROLLER

[76] Inventor: Deanna R. Dickson, 1567 W. Tedmar, Anaheim, Calif. 92802

[ * ] Notice: This patent issued on a continued prosecution application filed under 37 CFR 1.53(d), and is subject to the twenty year patent term provisions of 35 U.S.C. 154(a)(2).

[21] Appl. No.: 658,133

[22] Filed: Jun. 4, 1996

[51] Int. Cl.[6] ..... A45D 2/20

[52] U.S. Cl. ..... 132/247; 132/253

[58] Field of Search ..... 132/251, 252, 132/247, 273, 222, 223, 259

[56] References Cited

U.S. PATENT DOCUMENTS

| | | | |
|---|---|---|---|
| 672,506 | 4/1901 | Godward . | |
| 1,009,923 | 11/1911 | Moll | 132/247 |
| 1,346,920 | 7/1920 | Steinacher . | |
| 1,538,809 | 5/1925 | Henry | 132/247 |
| 2,061,817 | 11/1936 | Van Cleef . | |
| 2,422,716 | 6/1947 | Broyles | 132/247 |
| 2,524,266 | 10/1950 | Licastro | 132/246 |
| 2,693,809 | 11/1954 | Spencer . | |
| 3,003,505 | 10/1961 | Otto et al. | 132/251 |
| 4,310,008 | 1/1982 | Lalli | 132/247 |
| 4,465,084 | 8/1984 | Fulgoni | 132/252 |
| 5,025,816 | 6/1991 | Jones . | |
| 5,144,968 | 9/1992 | Rivera | 132/247 |
| 5,372,152 | 12/1994 | Dutch . | |

*Primary Examiner*—John J. Wilson
*Assistant Examiner*—Pedro Philogene
*Attorney, Agent, or Firm*—Morland C. Fischer

[57] ABSTRACT

A flexible hair roller having a soft cylindrical central core surrounded by and sealed within a soft towel-like outer covering. A snap and a snap catch are located at opposite ends of the flexible hair roller so that the roller can be folded back and closed upon itself with the opposite ends being detachably connected together to form a loop configuration. By virtue of the foregoing, the wearer is able to achieve a variety of hair styles (e.g. a spiral curl) without using caustic chemicals or damaging heat or requiring that the hair be wet. Moreover, the flexible hair roller is washable, lightweight so as to be easily packaged and transported, and comfortable to wear through the night.

7 Claims, 4 Drawing Sheets

FLEXIBLE HAIR ROLLER

BACKGROUND OF THE INVENTION

1. Field of the Invention

This invention relates to a flexible hair roller having a resilient, open cell central core surrounded by a soft outer covering so that the hair roller can be folded upon itself and snap-locked in a closed loop configuration to provide the wearer with a variety of dry hair styles (e.g. a spiral curl) without using caustic chemicals or damaging heat.

2. Background Art

Hair rollers have long been used to enable a wearer to style his/her hair. In this regard, conventional hair rollers are typically characterized as being relatively heavy, of large size and manufactured from a hard (e.g. closed cell or plastic) material. Consequently, such hair rollers are uncomfortable to wear during the night, are inconvenient to store and/or transport, are not easily washable and tend to be obtrusive and unsightly when several are worn at the same time. What is more, many conventional hair rollers are best suited for use when the wearer's hair is wet and/or in combination with potentially caustic chemicals and damaging heat.

Some hair rollers are known to have a central wire extending therethrough. These rollers are not altogether flexible and are sometimes inconvenient to use. That is to say, the ends of the central wire, although covered, are known to tangle in the wearer's hair. In addition, these rollers are not very comfortable to sleep on and are often difficult to manipulate.

Examples of conventional flexible hair rollers are available by referring to one or more of the following United States patents:

4,540,006 Sep. 10, 1985

4,572,221 Feb. 25, 1986

4,648,414 Mar. 10, 1987

SUMMARY OF THE INVENTION

A flexible hair roller is disclosed having particular application for styling dry hair and including an elongated, generally tubular central core that is formed from a soft and resilient open cell material. The central core is surrounded by and sealed within an outer covering that is formed from a soft, towel-like material. The outer covering is longer than the central core so that a generally flat wing is established at each end of the hair roller. A snap is affixed to the wing at one end of the hair roller, and a snap catch is affixed to the wing at the opposite end of the hair roller. The snap and snap catch are adapted to be detachably connected together when the hair roller is folded upon itself so that the opposite ends thereof are turned towards and moved into contact with one another. In this case, the hair roller is retained in a closed loop configuration.

In use, the flexible hair roller is first laid flat and in transverse alignment across some of the wearer's hair to be curled. Next, the hair roller is rotated so that the wearer's hair is rolled up therearound. The flexible hair roller is then folded upon itself into a loop configuration, and the snap and snap catch are detachably connected to one another to hold the opposite ends of the roller together. It may be desirable for two or more of the flexible hair rollers in the loop configuration to be linked together for creating a small chain and thereby controlling the location of the wearer's curls and the curling style. Because of its soft and flexible nature, the wearer may sleep on the hair roller in either of the flat or folded configurations while avoiding discomfort and achieving a non-permanent hair style (e.g. a spiral curl) without the use of chemicals or heat.

DETAILED DESCRIPTION

Figure 1:
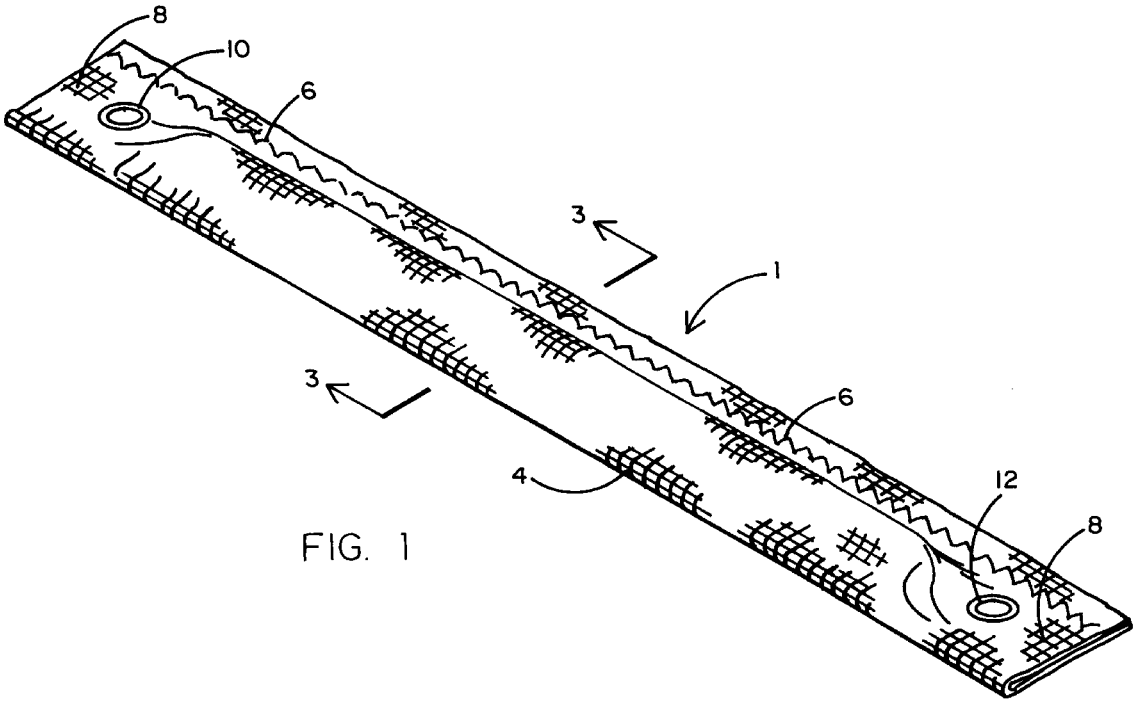
FIG. 1 is a perspective view of the flexible hair roller which forms the present invention.
Figure 2:
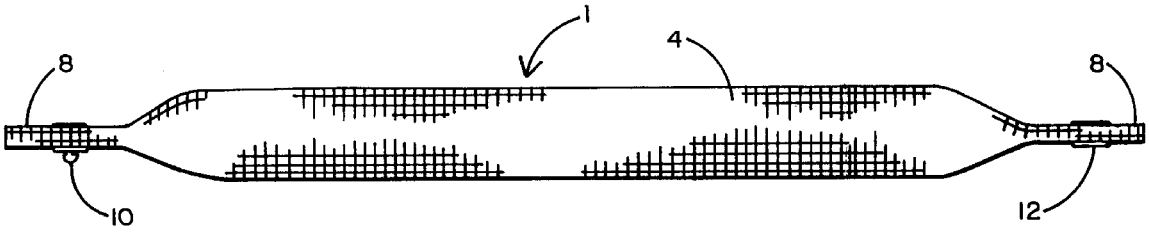
FIG. 2 is a side view of the hair roller of FIG. 1.
Figure 3:
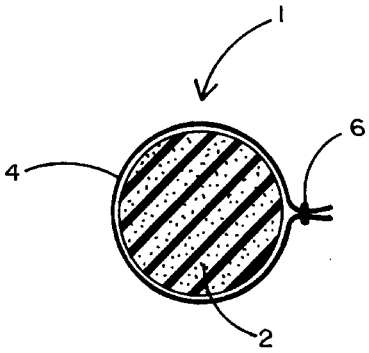
FIG. 3 is a cross-section of the hair roller taken along lines 3—3 of FIG. 1.

The flexible hair roller 1 which forms the present invention is initially described while referring to FIGS. 1–3 of the drawings. Hair roller 1 includes an elongated, generally cylindrical central core 2 (best shown in FIG. 3) that is formed from a soft and resilient open cell material (e.g. polyurethane). That is to say, the central core 2 of hair roller 1 may be bent back upon itself for an advantage that will be described in greater detail hereinafter when referring to FIGS. 6–8. Moreover, because of the soft construction of the central core 2, the wearer will not suffer appreciable discomfort when sleeping through the night with a plurality of hair rollers 1 being used to curl the wearer's hair.

The central core 2 of hair roller 1 is surrounded by and sealed within an envelope or outer covering 4. The covering 4 is a soft, absorbent and towel-like material, sometimes known as Terry cloth. To complete the assembly of hair roller 1, the central core 2 is first placed within the outer covering 4 and the covering is then closed around the core 2. The opposing edges of the covering 4 are stitched together to form a longitudinally extending seam (designated 6 in FIG. 1), whereby to retain the central core 2 at the interior of the outer covering 4.

The central core 2 is preferably slightly shorter than the outer covering 4 which is closed therearound. Therefore, a pair of relatively narrow and generally flat wings 8 are established at opposite ends of the hair roller 1. A conventional snap 10 is affixed to the wing 8 at one end of the hair roller 1, and a conventional receptacle or snap catch 12 is affixed to the wing 8 at the opposite end of the hair roller 1. As will soon be described, the snap 10 and snap catch 12 are adapted to be detachably connected together when the flexible hair roller 1 is folded upon itself so that the opposite ends thereof are turned towards and moved into contact with one another. In this case, and as is best shown in FIG. 6, the hair roller 1 can be retained in a closed loop configuration with the opposing wings 8 held in face-to-face alignment.

Figure 4:
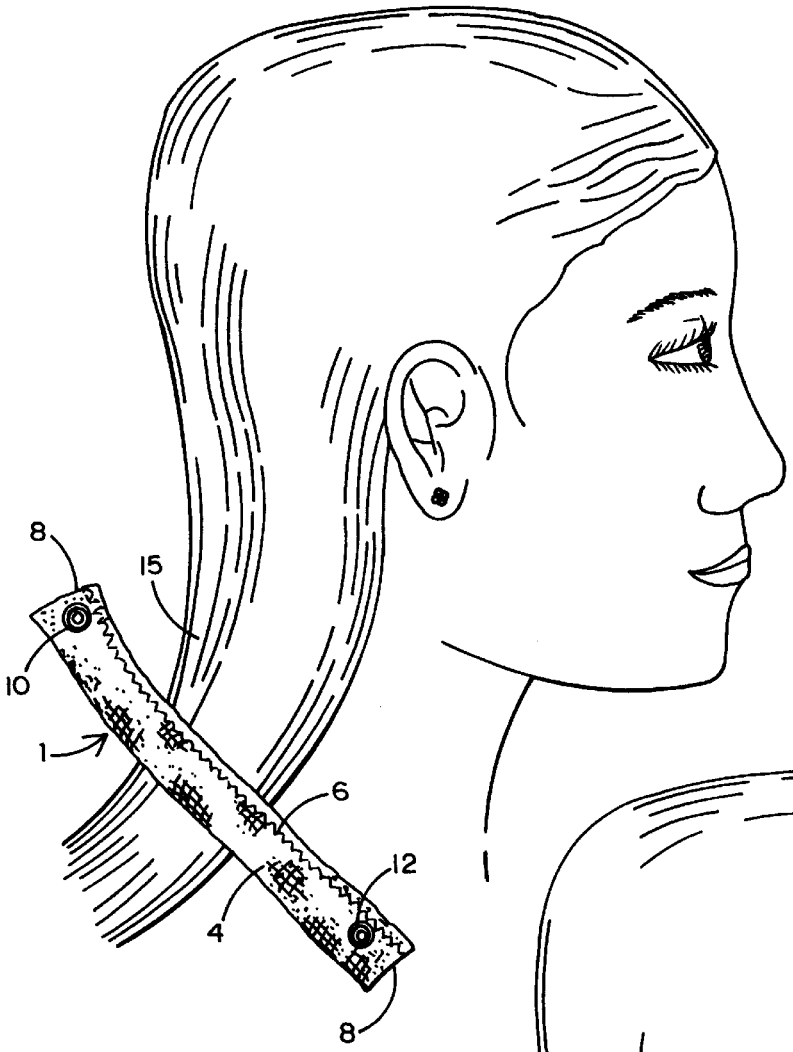
FIG. 4 shows the hair roller laid flat against and across some of the wearer's hair to be curled.
Figure 5:
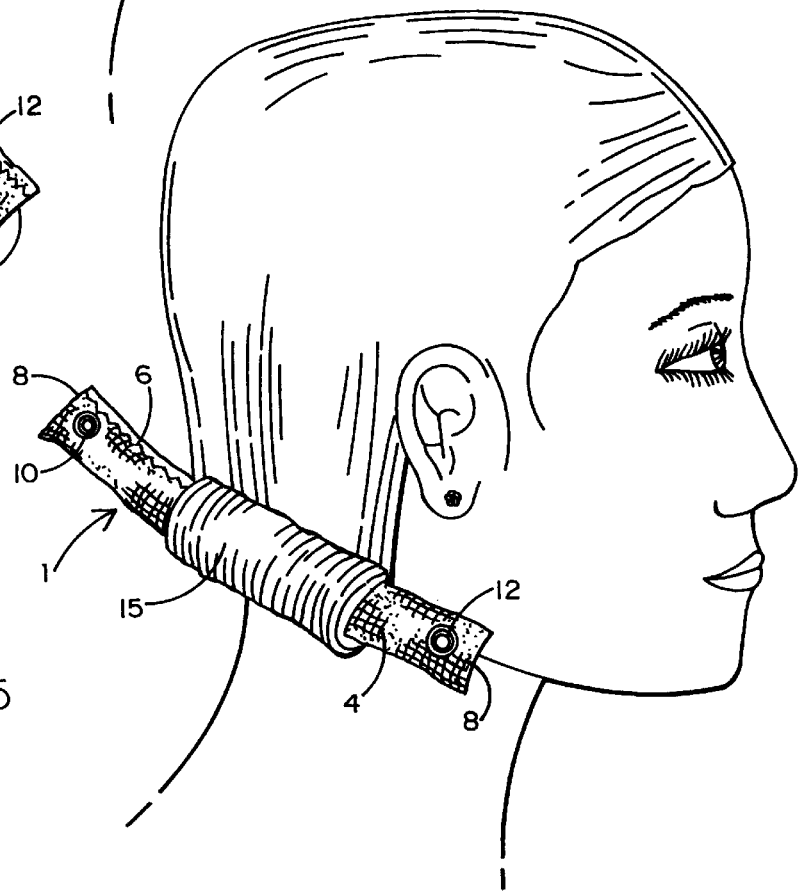
FIG. 5 shows the wearer's hair rolled up around the hair roller of FIG. 4.

FIGS. 4–8 of the drawings describe the application and use of the flexible hair roller 1 of this invention for curling and styling the hair of the wearer without chemicals or damaging heat. Referring first to FIG. 4, the hair roller 1 is laid flat against and in transverse alignment across some of the hair 15 to be curled. The wearer's hair is preferably dry, although the hair may contain a mousse, a gel, or the like. In FIG. 5, the hair roller 1 is then rotated a suitable number of times such that the wearer's hair 15 is rolled up therearound. It may be appreciated that the outer covering 4 provides a relatively rough surface for keeping the hair 15 rolled up around the roller 1.

Figure 6:
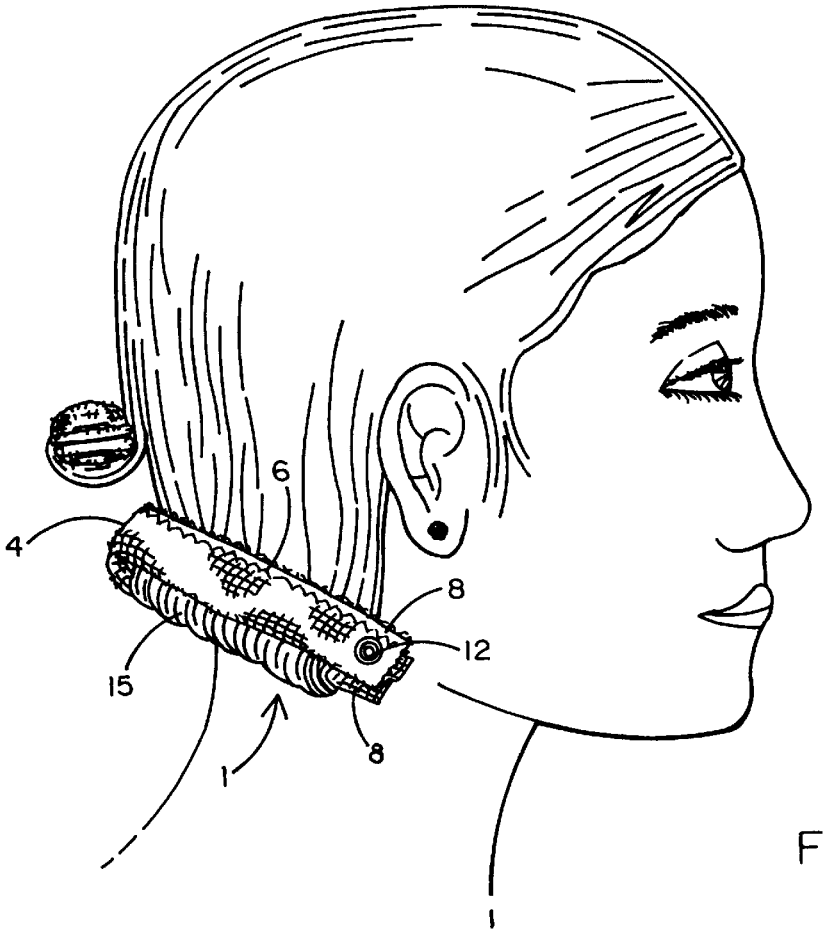
FIGS. 6 and 7 show the hair roller of FIG. 5 folded upon itself and held in a loop configuration.
Figure 7:
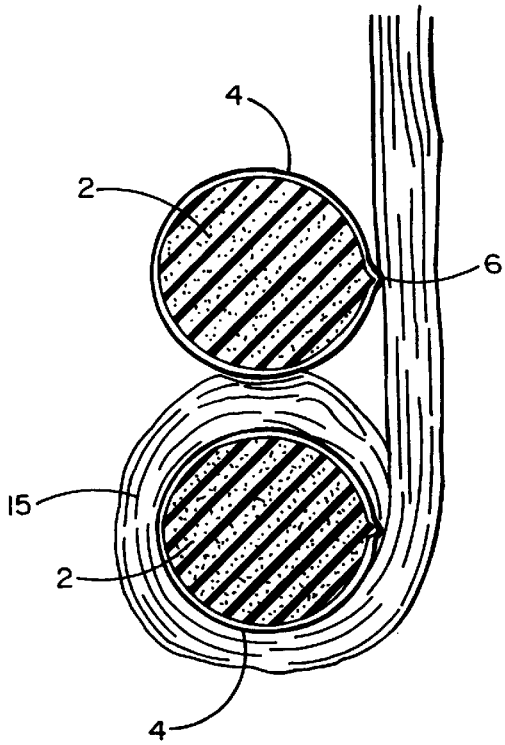

Next, and as shown in FIGS. 6 and 7, the resilient nature of the central core 2 enables the flexible hair roller 1 to be easily bent into a loop configuration with the wearer's hair 15 retained between opposing halves. The snap 10 and the snap catch (designated 12 in FIG. 4) are now detachably connected together, whereby the wings 8 at opposite ends of the roller 1 are located face-to-face one another to prevent the roller 1 from returning to the flat configuration of FIG. 5. In this same regard, and because the hair roller 1 is characterized as being both soft and lightweight, the wearer will experience minimal discomfort when sleeping in one or more of the hair rollers 1 that have been bent into the loop configuration of FIGS. 6 and 7.

Figure 8:
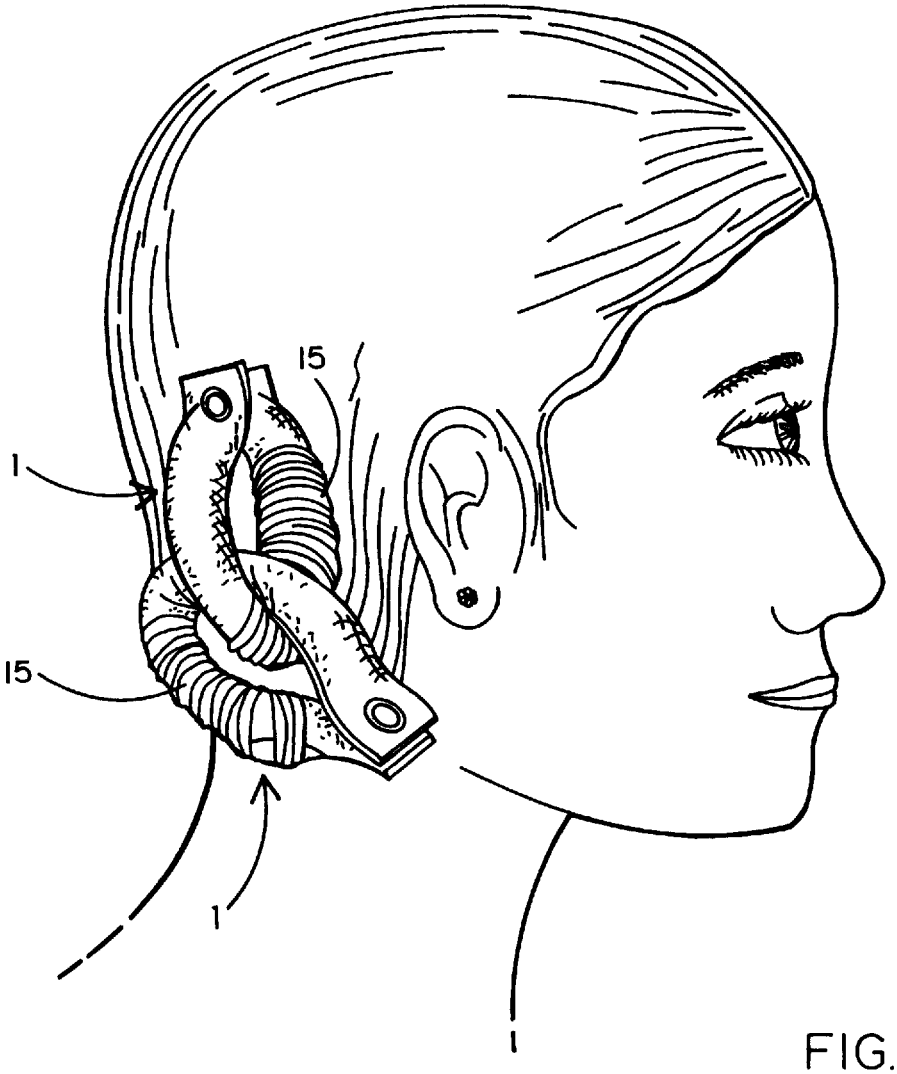
FIG. 8 shows two of the hair rollers in the loop configuration after being linked together.

Lastly, and turning now to FIG. 8, the wearer has the option of linking together two or more hair rollers 1 that have been bent and closed in the loop configuration. The foregoing interlinking has the effect of creating a small chain for controlling the tightness and location of the wearer's curls. Moreover, all of the inter-linked hair rollers 1 can be urged to a particular location at the wearer's head so as to achieve a particular styling effect. Of course, the hair rollers 1 may be easily opened and uncoupled from one another by simply unsnapping the snap 10 from its mating snap catch 12 and unrolling the wearer's hair 15 so as to enable hair roller 1 to return to its initial flat configuration.

The flexible hair roller 1 described above is particularly applicable to dry hair and enables the wearer to achieve a nonpermanent (e.g. spiral) curl that can be washed out the next day. The hair roller 1 is readily washable, easy to package and transport, comfortable to wear through the night, and simple to use for providing a variety of different hair styles without the cost and inconvenience of a salon.

It will be apparent that while a preferred embodiment of the invention has been shown and described, various modifications and changes may be made without departing from the true spirit and scope of this invention.

Having thus set forth the preferred embodiment, what is claimed is:

1. A hair styling system including a plurality of flexible hair rollers to be worn during sleep so as to enable the wearer's hair to be styled without subjecting the wearer to appreciable discomfort, each of said plurality of flexible hair rollers comprising a first end and an opposite end, an elongated central core formed from a soft, resilient material and extending between said first and opposite ends, a soft outer covering surrounding said central core and forming a surface around which the wearer's hair can be rolled, and first and second fasteners located respectively at said first and opposite ends so as to be mated to one another for connecting said first and second ends together, a first of said plurality of flexible hair rollers being folded to move said first end thereof towards said opposite end and thereby connect said first and second fasteners together for retaining said first hair roller in a closed loop, said first flexible hair roller in said closed loop being interlinked with at least a second of said plurality of flexible hair rollers in said closed loop to form a chain therebetween.

2. The hair styling system including a plurality of flexible hair rollers as recited in claim 1, wherein said resilient material from which said elongated central core is formed is a soft, open cell material.

3. The hair styling system including a plurality of flexible hair rollers as recited in claim 1, wherein said soft outer covering is an absorbent, towel material.

4. The hair styling system including a plurality of flexible hair rollers as recited in claim 1, wherein said first fastener is a snap and said second fastener is a snap catch.

5. The hair styling system including a plurality of flexible hair rollers as recited in claim 1, wherein said first and opposite ends at which said first and second fasteners are located are flat.

6. The hair styling system including a plurality of flexible hair rollers as recited in claim 1, wherein said elongated central core is a cylinder that extends substantially the entire length of said roller from said first end thereof to said opposite end.

7. A method for styling hair by wearing a flexible plurality of hair rollers, wherein each of said plurality of flexible hair rollers comprises a first end and an opposite end, an elongated central core formed from a soft, resilient material and extending between said first and opposite ends, a soft outer covering surrounding said central core and forming a surface around which the wearer's hair can be rolled, and first and second fasteners located respectively at said first and opposite ends so as to be mated to one another for connecting said first and second ends together, said method including the steps of:

folding a first of said plurality of hair rollers to move said first end thereof towards said opposite end and mating said first and second fasteners together for retaining said hair roller in a closed loop; and linking said first hair roller in said closed loop with at least a second of said plurality of hair rollers in said closed loop to form a chain therebetween.

* * * * *